US008920066B1

(12) United States Patent
Meyers

(10) Patent No.: US 8,920,066 B1
(45) Date of Patent: Dec. 30, 2014

(54) TACTILE SIDEWALK SURFACE

(75) Inventor: Theodore W. Meyers, Barrington, IL (US)

(73) Assignee: TUF-TITE, Inc., Lake Zurich, IL (US)

( * ) Notice: Subject to any disclaimer, the term of this patent is extended or adjusted under 35 U.S.C. 154(b) by 0 days.

(21) Appl. No.: 13/349,309

(22) Filed: Jan. 12, 2012

Related U.S. Application Data

(60) Provisional application No. 61/432,149, filed on Jan. 12, 2011.

(51) Int. Cl.
*E01C 11/24* (2006.01)

(52) U.S. Cl.
USPC ..... 404/19; 404/18; 404/42

(58) Field of Classification Search
USPC ..... 404/15, 18, 19, 21, 28, 33, 34, 35, 42
See application file for complete search history.

(56) References Cited

U.S. PATENT DOCUMENTS

| | | | | |
|---|---|---|---|---|
| 1,334,895 | A | 6/1920 | Irons | |
| 1,916,631 | A * | 7/1933 | Muchnic | 404/21 |
| 2,032,532 | A | 3/1936 | Eck | |
| 2,070,984 | A | 2/1937 | Collins | |
| 2,153,347 | A * | 4/1939 | Schenck | 404/21 |
| 3,418,781 | A | 12/1968 | Penote | |
| 3,950,908 | A | 4/1976 | Van Eyk | |
| 4,080,087 | A | 3/1978 | Phillips | |
| 4,380,996 | A | 4/1983 | Mengeringhausen | |
| 4,490,069 | A | 12/1984 | Cushman | |
| 4,674,251 | A | 6/1987 | Wolff | |
| 4,715,743 | A | 12/1987 | Schmanski | |
| 5,217,319 | A | 6/1993 | Klohn | |
| 5,271,690 | A | 12/1993 | Fennessy, Sr. | |
| 5,281,459 | A | 1/1994 | Van Eijck | |
| 5,302,049 | A | 4/1994 | Schmanski | |
| 5,303,669 | A | 4/1994 | Szekely | |
| 5,320,790 | A | 6/1994 | Lowe | |

(Continued)

FOREIGN PATENT DOCUMENTS

| | | |
|---|---|---|
| AU | 21483/35 | 2/1935 |
| CA | 2070984 | 6/1992 |

(Continued)

OTHER PUBLICATIONS

Engineered Plastics, Inc.'s Drawing No. ADA-P044-BA4-24M published on Engineered Plastics' website at least as early as May 2001.

(Continued)

*Primary Examiner* — Matthew D Troutman
(74) *Attorney, Agent, or Firm* — Marshall, Gerstein & Borun LLP

(57) ABSTRACT

A tactile sidewalk tile has a horizontal top surface and a horizontal bottom surface. A plurality of truncated domes project vertically from the top surface, and each of the truncated domes has a corresponding dome depression formed on the bottom surface. A sheet of tacky mounting material is applied to the horizontal bottom surface and is covered by a sacrificial release sheet until installation. According to one method of installing tactile sidewalk tile, the sacrificial release sheet is removed from the sheet of tacky mounting material, the tactile sidewalk tile is placed on an underlying sidewalk surface, pressure is applied to the horizontal top surface, and anchor holes are drilled using a plurality of fastener-receiving bores in the tactile sidewalk tile as guides.

22 Claims, 9 Drawing Sheets

(56) References Cited

U.S. PATENT DOCUMENTS

| | | | | |
|---|---|---|---|---|
| 5,328,293 | A | 7/1994 | Keefe | |
| 5,386,782 | A | 2/1995 | Dinis et al. | |
| 5,526,766 | A | 6/1996 | Armstrong et al. | |
| 5,616,650 | A | 4/1997 | Becker et al. | |
| 5,637,641 | A | 6/1997 | Becker et al. | |
| 5,733,997 | A | 3/1998 | Becker et al. | |
| 5,741,878 | A | 4/1998 | Becker et al. | |
| 5,750,628 | A | 5/1998 | Becker et al. | |
| 5,755,527 | A | 5/1998 | Dufresne | |
| 5,767,218 | A | 6/1998 | Becker et al. | |
| 5,775,835 | A | 7/1998 | Szekely | |
| 5,807,954 | A | 9/1998 | Becker et al. | |
| 5,827,009 | A | 10/1998 | Kokoletsos | |
| 5,838,238 | A | 11/1998 | Abita et al. | |
| 5,840,396 | A | 11/1998 | Betz | |
| 5,845,580 | A | 12/1998 | Muller et al. | |
| 5,927,034 | A | 7/1999 | Cole | |
| 5,933,082 | A | 8/1999 | Abita et al. | |
| 6,153,282 | A | 11/2000 | Dickinson et al. | |
| 6,153,828 | A | 11/2000 | Murata et al. | |
| 6,173,653 | B1 | 1/2001 | Edelmann | |
| 6,273,657 | B1 | 8/2001 | Vorona | |
| 6,449,790 | B1 | 9/2002 | Szekely | |
| 6,450,728 | B1 | 9/2002 | Grahmbeek et al. | |
| 6,453,630 | B1 | 9/2002 | Buhrts et al. | |
| 6,485,226 | B1 | 11/2002 | Harger | |
| 6,488,618 | B1 | 12/2002 | Paolitto et al. | |
| 6,699,553 | B1 | 3/2004 | Koket | |
| 6,709,191 | B1 | 3/2004 | McCuskey | |
| 6,718,714 | B1 | 4/2004 | Montgomery | |
| 6,740,388 | B1 * | 5/2004 | Koket | 428/100 |
| 6,802,159 | B1 | 10/2004 | Kotler | |
| 6,890,124 | B2 | 5/2005 | Provenzano, III | |
| 6,895,622 | B2 | 5/2005 | Szekely | |
| 6,939,078 | B1 | 9/2005 | Anderson et al. | |
| 6,951,435 | B1 | 10/2005 | Fennessy, Sr. | |
| 6,951,436 | B2 | 10/2005 | Stegemeier et al. | |
| 6,960,989 | B1 | 11/2005 | Grayson | |
| 6,964,244 | B2 | 11/2005 | Stockton | |
| 6,971,818 | B1 | 12/2005 | Schabacker | |
| 6,979,317 | B2 | 12/2005 | Galt et al. | |
| 7,000,279 | B2 | 2/2006 | Szekely | |
| 7,000,361 | B1 | 2/2006 | Merriman et al. | |
| 7,001,103 | B2 | 2/2006 | Sippola | |
| 7,052,495 | B2 | 5/2006 | Smith | |
| 7,114,298 | B2 | 10/2006 | Kotler | |
| 7,121,048 | B1 | 10/2006 | Merriman et al. | |
| 7,142,095 | B1 | 11/2006 | Grayson | |
| 7,182,548 | B1 | 2/2007 | Womack | |
| 7,189,025 | B1 | 3/2007 | Greer et al. | |
| 7,223,048 | B1 | 5/2007 | Greer et al. | |
| 7,249,911 | B2 | 7/2007 | Hyams | |
| 7,267,281 | B2 | 9/2007 | Hopkins | |
| 7,438,694 | B2 | 10/2008 | Boozer et al. | |
| 7,674,066 | B2 | 3/2010 | Wehmeyer | |
| 7,758,279 | B2 * | 7/2010 | Driscoll | 404/19 |
| 7,779,581 | B2 | 8/2010 | Flaherty et al. | |
| 7,845,122 | B2 * | 12/2010 | Sippola | 52/177 |
| 7,992,360 | B2 * | 8/2011 | Driscoll | 52/747.11 |
| 7,993,074 | B1 * | 8/2011 | Driscoll | 404/19 |
| 8,028,491 | B2 | 10/2011 | Flaherty et al. | |
| 8,146,302 | B2 * | 4/2012 | Sippola | 52/177 |
| 8,192,623 | B2 | 6/2012 | Reid et al. | |
| 2002/0149570 | A1 | 10/2002 | Knowles et al. | |
| 2003/0037720 | A1 | 2/2003 | Stockton | |
| 2003/0084523 | A1 | 5/2003 | Szekely | |
| 2004/0042850 | A1 | 3/2004 | Provenzano, III | |
| 2004/0067336 | A1 | 4/2004 | Munroe | |
| 2005/0013662 | A1 | 1/2005 | Provenzano, III | |
| 2005/0031415 | A1 | 2/2005 | Sippola | |
| 2005/0066623 | A1 | 3/2005 | Sippola | |
| 2005/0144743 | A1 | 7/2005 | Szekely | |
| 2005/0265782 | A1 | 12/2005 | Everett | |
| 2006/0024132 | A1 | 2/2006 | Seman | |
| 2006/0037155 | A1 | 2/2006 | Szekely | |
| 2006/0039752 | A1 | 2/2006 | Hyams | |
| 2006/0108426 | A1 | 5/2006 | Hopkins | |
| 2006/0174567 | A1 | 8/2006 | Sippola | |
| 2006/0188680 | A1 | 8/2006 | Everett | |
| 2006/0210766 | A1 | 9/2006 | Press et al. | |
| 2006/0227009 | A1 | 10/2006 | Koehn | |
| 2006/0245827 | A1 | 11/2006 | Rydin et al. | |
| 2007/0028531 | A1 | 2/2007 | Woodcock | |
| 2007/0059441 | A1 | 3/2007 | Greer | |
| 2007/0086859 | A1 | 4/2007 | Julnes | |
| 2007/0092335 | A1 | 4/2007 | Wehmeyer | |
| 2007/0196169 | A1 | 8/2007 | Logan et al. | |
| 2007/0201949 | A1 | 8/2007 | Veldboom et al. | |
| 2007/0212190 | A1 | 9/2007 | Monday et al. | |
| 2007/0269264 | A1 | 11/2007 | Boghossian | |
| 2008/0008526 | A1 | 1/2008 | Boghossian | |
| 2008/0229703 | A1 | 9/2008 | Driscoll | |
| 2008/0280097 | A1 | 11/2008 | Flaherty et al. | |
| 2010/0313502 | A1 | 12/2010 | Flaherty et al. | |
| 2011/0185961 | A1 | 8/2011 | Flaherty et al. | |
| 2012/0017823 | A1 | 1/2012 | Flaherty et al. | |
| 2012/0073492 | A1 | 3/2012 | Flaherty et al. | |
| 2012/0076579 | A1 | 3/2012 | Flaherty et al. | |
| 2012/0076580 | A1 | 3/2012 | Flaherty et al. | |
| 2012/0124936 | A1 | 5/2012 | Flaherty et al. | |

FOREIGN PATENT DOCUMENTS

| | | |
|---|---|---|
| CA | 2032532 | 5/1994 |
| CA | 2092367 | 9/1994 |
| EP | 0425901 A1 | 5/1991 |
| GB | 379690 | 8/1932 |
| GB | 433732 | 8/1935 |
| GB | 486128 | 5/1938 |

OTHER PUBLICATIONS

Engineered Plastics, Inc.'s Drawing No. ADT-S203-GEN2-06X48 published on Engineered Plastics' website at least as early as May 2001.

Engineered Plastics, Inc.'s Drawing No. ADA-C-1212 published on Engineered Plastics' website at least as early as Apr. 2004.

* cited by examiner

TACTILE SIDEWALK SURFACE

REFERENCE TO RELATED APPLICATIONS

This is the non-provisional of U.S. Provisional Patent Appl. No. 61/432,149, filed Jan. 12, 2011, and claims the benefit of the filing date thereof under 35 USC §119(e). The entire disclosure of U.S. Provisional Patent Appl. No. 61/432,149 is incorporated herein by reference.

FIELD OF THE DISCLOSURE

This disclosure relates generally to embedded sidewalk tile, and more particularly, to a tactile sidewalk tile for detection by visually impaired pedestrians.

BACKGROUND OF THE INVENTION

The Americans With Disabilities Act ("ADA") mandates detectable warnings, such as tactile surfaces, in prescribed locations to assist blind or visually impaired pedestrians. Typical locations for detectable warnings are traffic crossings, stairways, and the edge of rail platforms.

Commonly, tactile surfaces are formed as thin mats having a series of raised truncated domes and a plurality of smaller pointed nubs arrayed on the top surface. The tactile surface is placed over wet concrete and the underside of the tactile surface bonds to the concrete underlayer. If the top surface of the tactile surface becomes worn or damaged, the entire tactile surface, and the concrete attached thereto, must be removed. The tactile surface must then be replaced in the same manner as it was originally installed. Specifically, concrete must be poured and a new tile must be bonded to that concrete. This process is both time consuming and expensive.

A second type of tactile surface allows for the insertion and removal of individual truncated domes. A mat having an array of pre-cut circular holes is bonded to a concrete underlayer as described above. Cylindrical holes are formed in the concrete underlayer to correspond with the holes in the mat. Cylindrical inserts are vertically bonded into the cylindrical holes, and the end of the cylindrical insert that protrudes from the mat comprises the truncated dome. If the truncated dome becomes damaged, the insert can be removed and replaced. However, if the mat becomes worn or damaged, the mat and the concrete bonded thereto must be removed. Again, this process is expensive and time consuming.

The tactile sidewalk tile of the present disclosure overcomes these and other shortcomings of conventional tactile surfaces. As compared to conventional tactile surfaces, the tactile sidewalk tile of the present disclosure is inexpensive to produce and simple to install and replace.

BRIEF SUMMARY OF THE INVENTION

The tactile sidewalk tile of the present disclosure comprises a tile having a horizontal top tile surface, a horizontal bottom tile surface, and an edge portion extending between the top tile surface and the bottom tile surface. A plurality of truncated domes project vertically upward from the top tile surface, and each of the truncated domes has a corresponding downwardly-open dome depression formed on the bottom tile surface. A flush post is disposed in at least one, and preferably all, of the plurality of dome depressions, and the flush post may have an elongated flush post body. A flush post protrusion may extend horizontally from the flush post body, and the sides of the flush post protrusion may be defined by the outer surface of the flush post. The top of the flush post protrusion may be defined by a partially circular and substantially horizontal flush post top surface, and the flush post top surface and the bottom tile surface may be substantially coplanar. A flush post front protrusion wall may comprise a front surface of the flush post protrusion, and the flush post front protrusion wall may be planar and extend vertically downward from the flush post top surface. The flush post protrusion may also include a flush post undercut surface that obliquely extends from the flush post body to the flush post front protrusion wall. The flush post undercut surface is at least partially disposed within a dome depression volume, which is at least partially defined by the inner surface of the dome depression and a plane extending across the bottom tile surface. A plurality of vertical ribs may extend radially between the flush post body and the inner surface of the dome depression.

In one method of installation of the tactile sidewalk tile of the present disclosure, an underlayer of concrete is first poured as a base in the area to be covered by the tactile sidewalk tile. Prior to the placement of the tactile sidewalk tile in the desired position, the tactile sidewalk tile is inverted and a layer of thinset material is "buttered" over the bottom tile surface such that the thinset material spills into the dome depressions. A layer of the thinset material is then buttered over the underlayer of wet concrete. The tactile sidewalk tile is next placed in the desired position and pressed downwards towards the wet concrete such that the dome depression volume is at least partially filled with the thinset material and the thinset material extends beyond a portion of the flush post undercut surface. As the thinset material dries around each flush post undercut surface, the flush posts become anchored to the concrete underlayer, providing a plurality of contact points to create a strong bond between the tactile sidewalk tile and the thinset layer. To remove a damaged tactile sidewalk tile, the tile can be pried up using a conventional chisel or a crowbar and replaced in the manner described above.

In a second embodiment, the tactile sidewalk tile may be substantially identical to the tactile sidewalk tile that has been previously described. However, instead of having a vertical edge portion, the top tile surface is bounded by a substantially vertical sidewall that extends around the perimeter of the top tile surface. The sidewall extends a distance from the top tile surface, and, optionally, an inwardly-projecting lip may horizontally extend along a distal edge of the sidewall. To install the tactile sidewalk tile, the tactile sidewalk tile is first inverted, and a filler material is poured into the volume that is defined by the interior of the sidewall and the bottom tile surface. The filler material may be added until the filler material contacts an inner surface of the lip such that upon drying, the filler material is at least partially retained in the volume by the lip. If the tactile sidewalk tile does not have a lip, the filler material may be added until the level of the filler material is substantially adjacent with the distal edge of the sidewall. Under the influence of gravity, the filler material flows into the dome depression volume V, and the filler material consequently extends beyond a portion of the flush post undercut surface, securing the tactile sidewalk tile to the filler material in the manner previously described. The filler material may also be secured to the tactile sidewalk tile by one or more retention ribs, which each extend away from an interior surface of the sidewall and which each have a T-shaped cross-section. By using the process described above, a plurality of tactile sidewalk tiles may be prepared at an off-site location and shipped to the job site, thereby reducing on-site preparation time. Each of the tactile sidewalk tiles can then be installed in a desired location in a manner similar to that of a paving stone.

DETAILED DESCRIPTION OF THE INVENTION

Provided is a tactile sidewalk tile and method for attaching and detaching the tactile sidewalk tile to a base surface, such as concrete. The tactile sidewalk tile may be formed from any suitable material. For example, the tactile sidewalk tile may be formed by plastic. Preferably, the tactile sidewalk tile is formed using injection molded plastic, such as Nylon, PVC, polypropylene, PC/PBT, copolymer polyester, PC/ABS, and most preferably, an injection molded copolymer polyester. The tactile sidewalk tile may be painted or formed from a dyed material.

Figure 1:
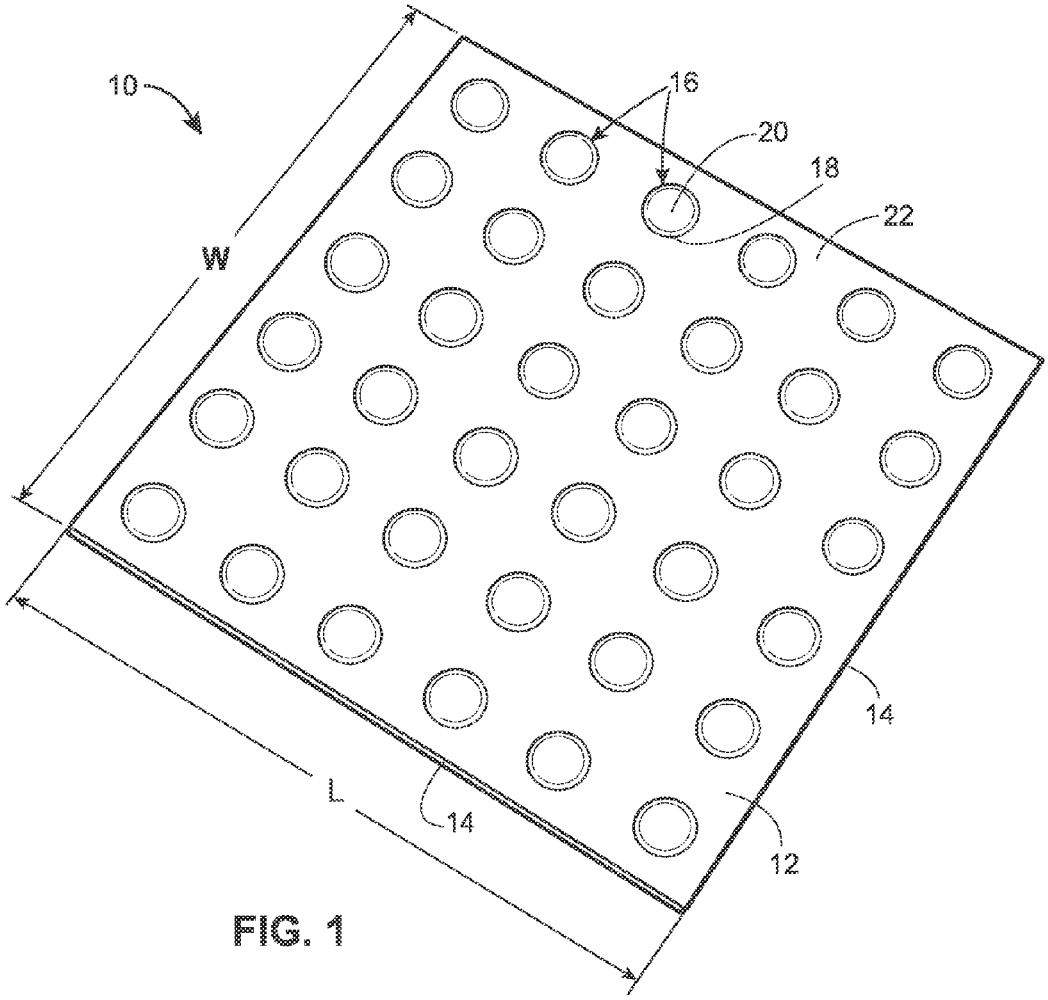
FIG. 1 is a perspective top view of a tactile sidewalk tile of the present disclosure.
Figure 2A:
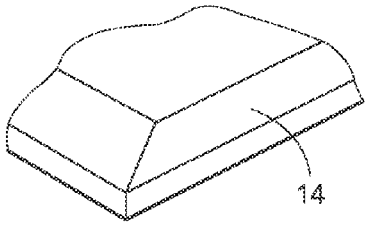
FIG. 2A is a partial perspective view of an edge of an embodiment of the tactile sidewalk tile of the present disclosure.
Figure 2B:
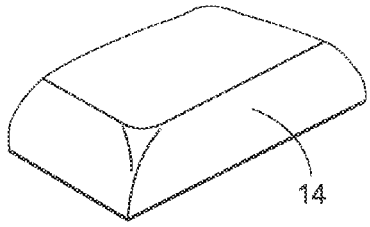
FIG. 2B is a partial perspective view of an edge of an embodiment of the tactile sidewalk tile of the present disclosure.

In a first embodiment that is illustrated in FIG. 1, the tactile sidewalk tile 10 has a horizontal or generally horizontal top tile surface 12 having a width W and a length L. The width W and the length L may preferably be 12 inches by 12 inches or 24 inches by 24 inches, respectively. However, the width W and the length L may vary depending on the application. The top tile surface 12 is bounded by an edge portion 14 that extends around the perimeter of the tactile sidewalk tile 10. The edge portion 14 may be a substantially vertical surface, as shown in FIG. 1. Alternatively, the edge portion may be a mitered edge, as shown in FIG. 2A, or a bull nose trim, as shown in FIG. 2B. In these embodiments, the edge portion 14 does not extend below a horizontal bottom tile surface, but rather, is flush with the horizontal bottom tile surface. A plurality of truncated domes 16 may be arrayed across the top tile surface 12 to form a pattern. The pattern may be an array of aligned rows and columns, as illustrated in FIG. 1. Alternatively, the pattern may be a checkerboard pattern of aligned rows and staggered columns, or any other arrangement of truncated domes 16 suitable for a given application. The size and shape of the truncated domes 16 on the top tile surface 12 of the present disclosure may be any of those well known in the art. For instance, each truncated dome 16 may be defined by an annular or generally annular dome wall 18 that projects from the top tile surface 12. The dome wall 18 may have a generally rounded or contoured shape, such as a convex shape, when viewed in cross-section, such as in FIG. 5. Alternatively, the cross-sectional shape may be linear and non-contoured. A horizontal or generally horizontal dome top surface 20 may define the top surface of the truncated dome 16, and the overall shape of the truncated dome 16 may thus resemble that of the exterior of an inverted bowl.

In a preferred embodiment, the nominal thickness of the tactile sidewalk tile 10 of the present disclosure, not including the domes, is approximately 0.140 inch.

Figure 3A:
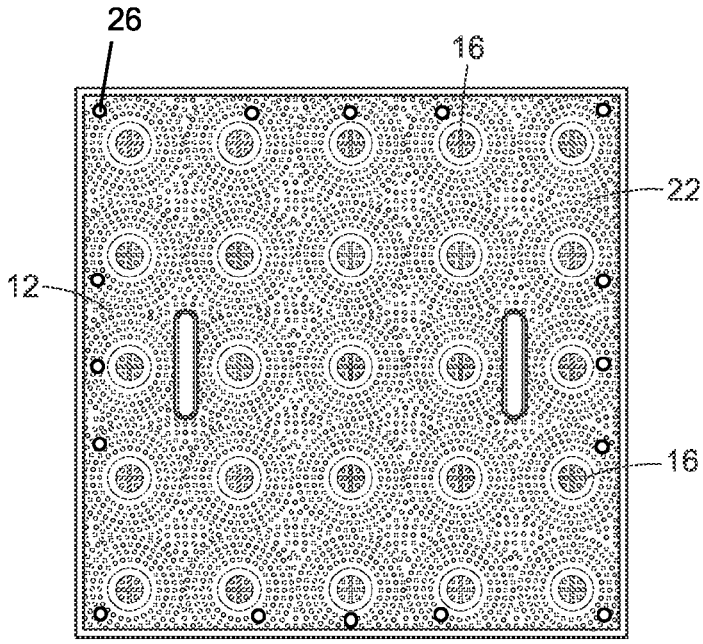
FIG. 3A is a top view of an embodiment of the tactile sidewalk tile of the present disclosure.
Figure 3B:
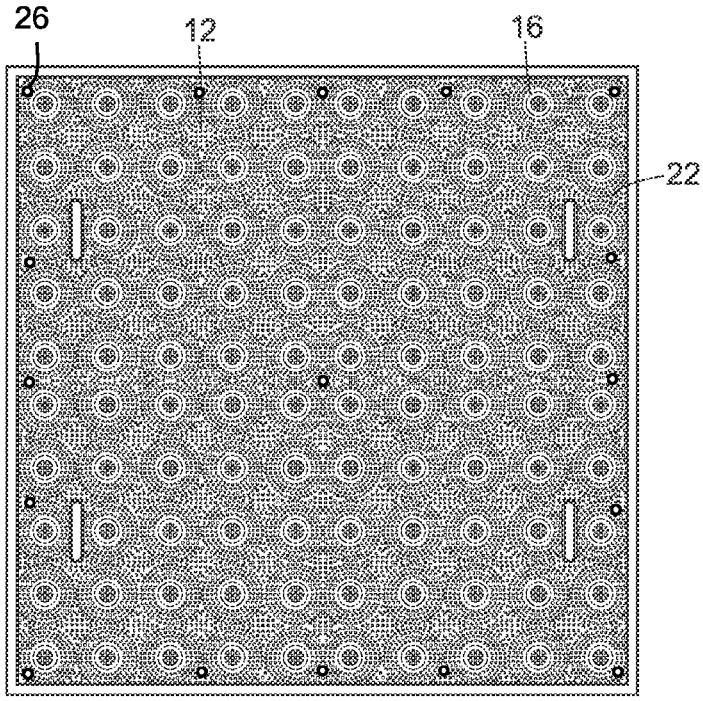
FIG. 3B is a top view of an embodiment of the tactile sidewalk tile of the present disclosure.

A plurality of conical pointed nubs 22 may project vertically from the top tile surface 12 and the dome top surface 18, as illustrated in FIGS. 3A, 3B. The plurality of pointed nubs 22 may form a pattern on the top tile surface 12, and the pattern may include a plurality of concentric circles expanding outwardly from each truncated dome 16, as shown in the 12"×12" tactile sidewalk tile 10 illustrated in FIG. 3A and the 24"×24" tactile sidewalk tile 10 illustrated in FIG. 3B. The entire top tile surface 12 may be textured to improve the overall visual appearance of the tactile sidewalk tile 10. Alternatively, a texture may not be formed on the top tile surface 12. The tactile sidewalk tile 10 is also preferably provided with a plurality of bores 26, to receive anchoring bolts or similar fasteners (not shown). By way of example only, the bores 26 may have a diameter of approximately 0.260 inch.

Figure 4:
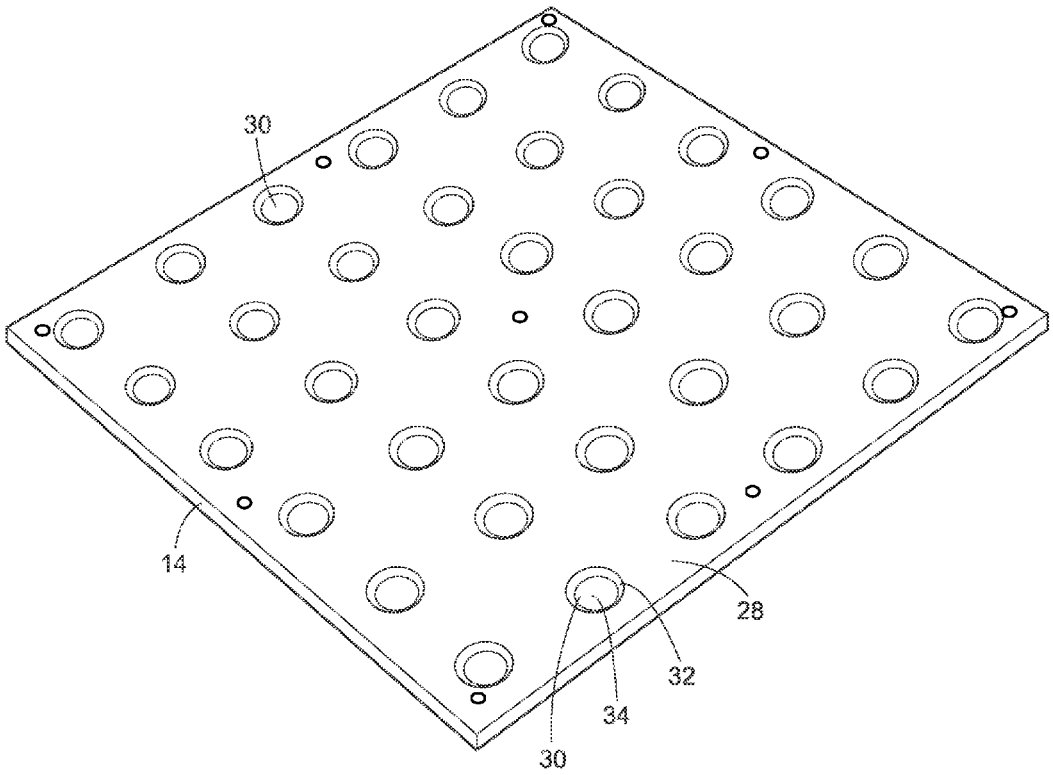
FIG. 4 is a perspective bottom view of an embodiment of the tactile sidewalk tile of the present disclosure.

Referring to FIG. 4, the tactile sidewalk tile 10 also has a horizontal or generally horizontal bottom tile surface 28 opposite the top tile surface 12, and the bottom tile surface 28 may be bordered by the edge portion 14 disposed along the periphery of the tactile sidewalk tile 10, but being flush with, i.e. not extending below, the generally horizontal bottom tile surface 28. A plurality of dome depressions 30 may be arrayed across the bottom tile surface 28, and each dome depression 30 may be the underside of a corresponding truncated dome 16 formed on the top tile surface 12. Each dome depression 30 may be defined by an inner dome wall 32 that generally corresponds in shape to the dome wall 18 on the top tile surface 12, and a dome bottom surface 34 that generally corresponds in shape to the dome top surface 20. Because the general shape of the truncated dome 16 may resemble that of the exterior of an inverted bowl when viewed from the top tile surface 12, the general shape of the dome depression 30 may thus resemble that of the interior of a bowl when viewed from the bottom tile surface 28. As configured, a dome depression volume V may be at least partially defined by the inner dome wall 32, the dome bottom surface 34, and a plane extending across the bottom tile surface 28.

Figure 6:
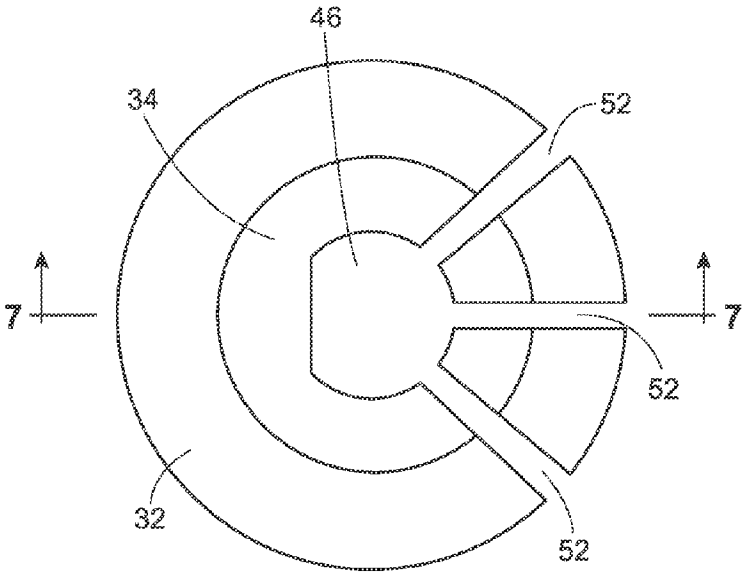
FIG. 6 is a top view of a flush post.
Figure 5:
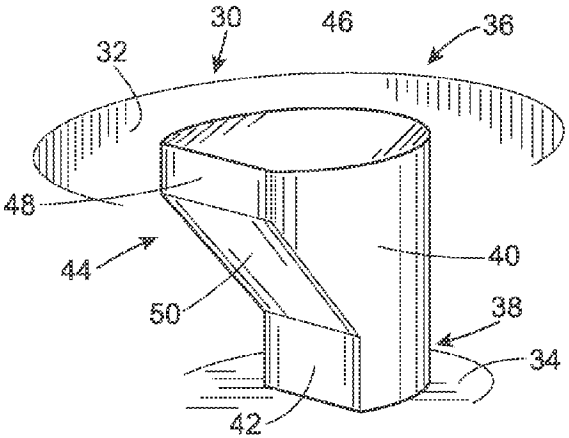
FIG. 5 is a perspective view of a flush post without ribs.
Figure 7:
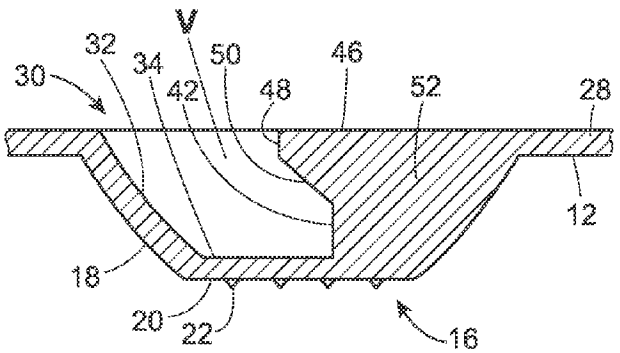
FIG. 7 is a cross-sectional view of the flush post taken along sectional line 7-7 in FIG. 6.

A flush post 36 may be disposed within any of the dome depressions 30. Preferably, however, each of the dome depressions 30 includes a flush post 36. As illustrated in FIGS. 5, 6, and 7, the flush post 36 may include a flush post body 38 extending vertically from the dome bottom surface 34, and the flush post body 38 may be partially defined by a flush post outer surface 40. The flush post body 38 may have a partially circular cross-sectional shape giving the flush post outer surface 40 the shape of a partial cylinder. However, the cross-sectional shape of the flush post body 38 may have any shape, such as an oval or a polygon, or a combination of shapes. The flush post body 38 may also include a vertical or substantially vertical flush post inner wall 42 disposed between the lateral boundaries of the flush post outer surface 40. The flush post inner wall 42 may be planar, as shown in FIGS. 5, 6, and 7. Alternatively, the flush post inner wall 42 may be have a convex shape, or may comprise a combination of planar and rounded surfaces.

Still referring to FIGS. 5, 6, and 7, the flush post 36 may also include a flush post protrusion 44 that may extend in a horizontal or generally horizontal direction away from the flush post body 38. The sides of the flush post protrusion 44 may be defined by the flush post outer surface 40. The top of the flush post protrusion 44 may be defined by a partially circular and substantially horizontal flush post top surface 46, and the flush post top surface 46 and the bottom tile surface 28 may be coplanar or substantially coplanar. However, the flush post top surface 46 may either extend beyond the bottom tile surface 28 or may not extend past the bottom tile surface 28. A flush post front protrusion wall 48 may comprise a front surface of the flush post protrusion 44. The flush post front protrusion wall 48 may be planar and vertical or substantially vertical, as shown in FIGS. 5, 6, and 7. However, the flush post front protrusion wall 48 may have a substantially concave shape, or may be comprised of a plurality of curved and planar surfaces. The flush post protrusion 44 may also include a flush post undercut surface 50 that is at least partially disposed within the dome depression volume V. Preferably, however, the flush post undercut surface 50 is disposed entirely within the dome depression volume V. The flush post undercut surface 50 may define a surface that extends obliquely between the flush post front protrusion wall 48 and the flush post inner wall 42 and is laterally bounded on both sides by the flush post outer surface 40, as illustrated in FIG. 5. However, the flush post undercut surface 50 may define a surface that extends horizontally between the flush post front protrusion wall 48 and the flush post inner wall 42. The flush post undercut surface 50 may be comprised of a single planar surface, as illustrated in FIGS. 5, 6, and 7. Alternatively, the flush post undercut surface 50 may have a concave shape or may be comprised of a combination of planar and curved surfaces.

Figure 8:
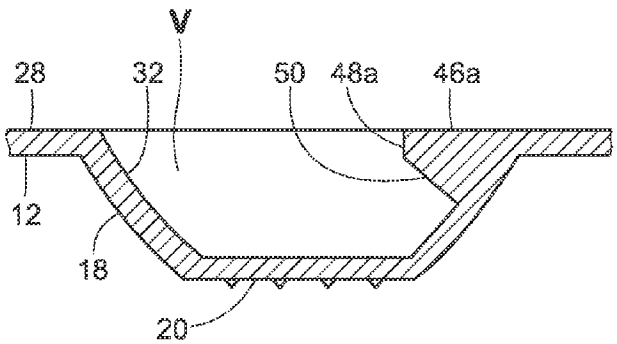
FIG. 8 is a cross-sectional view, similar to the view of FIG. 7, of an alternative embodiment of the flush post.

In another embodiment of the flush post 36*a* that is illustrated in FIG. 8, a flush post protrusion 44*a* may extend in a horizontal or generally horizontal direction from the inner dome wall 32. The flush post protrusion 44*a* may include a horizontal or substantially horizontal flush post top surface 46*a* that may be coplanar with the bottom tile surface 28. A flush post front protrusion wall 48*a* may vertically intersect the flush post top surface 46*a*. Additionally, a flush post undercut surface 50 may define a surface that extends obliquely between the flush post front protrusion wall 48*a* and the inner dome wall 32. Conversely, the flush post undercut surface 50*a* may extend horizontally between the flush post front protrusion wall 48*a* and the inner dome wall 32.

Referring to FIGS. 6 and 7, a plurality of vertical ribs 52 may extend radially between the flush post body 38 and the inner dome wall 32. The top surface of each rib 52 may be coplanar or substantially coplanar with the bottom tile surface 28 or may be coplanar with the flush post top surface 46. The ribs 52 are adapted to strengthen the flush post 36 and prevent horizontal deformation due to shearing loads on the flush post 36.

The bottom tile surface 28, the inner dome wall 32, and portions of the bottom dome surface 34 are preferably textured, and, more specifically, textured with an aggressive pattern such as Shammy 45. The relatively rough texture formed by the aggressive pattern on the bottom tile surface 28, the inner dome wall 32, and portions of the bottom dome surface 34 allows a thin-set material to adhere to the surfaces when the thin-set is applied in a manner that will be described in more detail below. The mold may be textured using electrical discharge machining (EDM), or by any other suitable texturing process known in the art.

Figure 9:
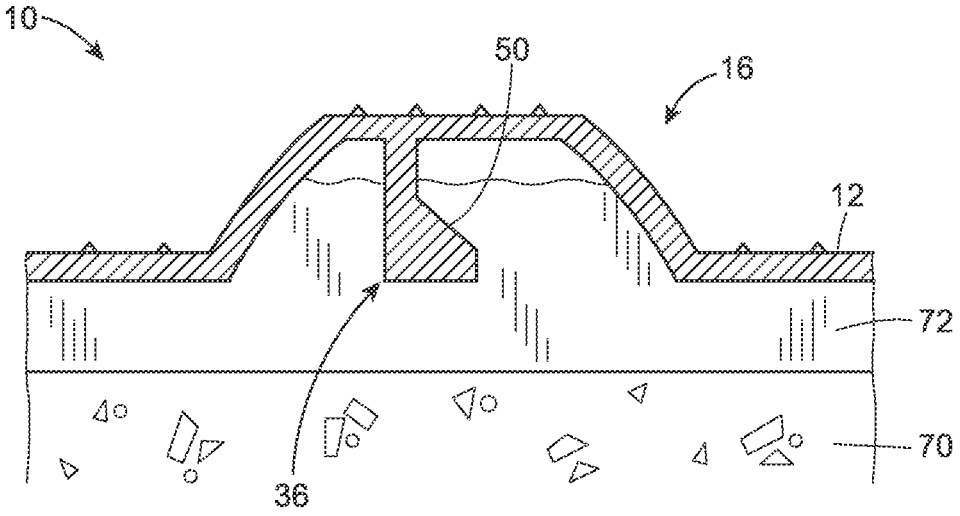
FIG. 9 is a sectional view of a flush post anchored to an underlying surface as described in the present disclosure.

The installation of the tactile sidewalk tile 10 will now be described in detail. First, an underlayer of concrete 70 is poured as a base in the area to be covered by the tactile sidewalk tile 10. Prior to the placement of the tactile sidewalk tile 10 in the desired position, the tactile sidewalk tile 10 is inverted and a layer of thinset material 72 is "buttered" over the bottom tile surface 28. Under the influence of gravity, the thinset material 72 then migrates into the dome depressions 30. The thinset material 72 may be any conventional adhesive or mortar known in the art, such as epoxy, or could be a blend of mortar that is mixed with latex instead of water. A layer of the thinset material 72 is then buttered over the underlayer of wet concrete 70. The tactile sidewalk tile 10 is next placed in the desired position and pressed downwards towards the wet concrete 70. A downward force is evenly applied over the top tile surface 12 such that the dome depression volume V is at least partially filled with the thinset material 72, and the thinset material 72 consequently extends beyond a portion of the flush post undercut surface 50, as shown in FIG. 9.

As the thinset material 72 dries around each flush post undercut surface 50, the flush posts 36 become anchored to the concrete 70 underlayer, providing a plurality of contact points to create a strong bond between the tactile sidewalk tile 10 and the thinset layer 72. Moreover, the rough texturing formed on the bottom tile surface 28, the inner dome wall 32, and the dome bottom surface 34 causes the thinset material 72 to adhere to the textured surfaces, thereby improving the bond between the tactile sidewalk tile 10 and the thinset layer 72. Because the thinset material 72 bonds to the concrete 70 when both materials harden, the tactile sidewalk tile 10 becomes firmly attached to the underlying surface 72.

If a tactile sidewalk tile 10 becomes damaged, the tactile sidewalk tile 10 can be easily replaced. Specifically, the damaged tactile sidewalk tile 10 can be pried up using a conventional chisel or a crowbar. If desired, the original thinset material 72 remaining can be partially or totally removed from the concrete underlayer. To replace the tactile sidewalk tile 10, a layer of thinset material 72 is buttered over the bottom tile surface 28 of an undamaged tactile sidewalk tile 10, and a layer of thinset material 72 is applied across the concrete surface 70 to be retiled, as described above.

Figure 10:
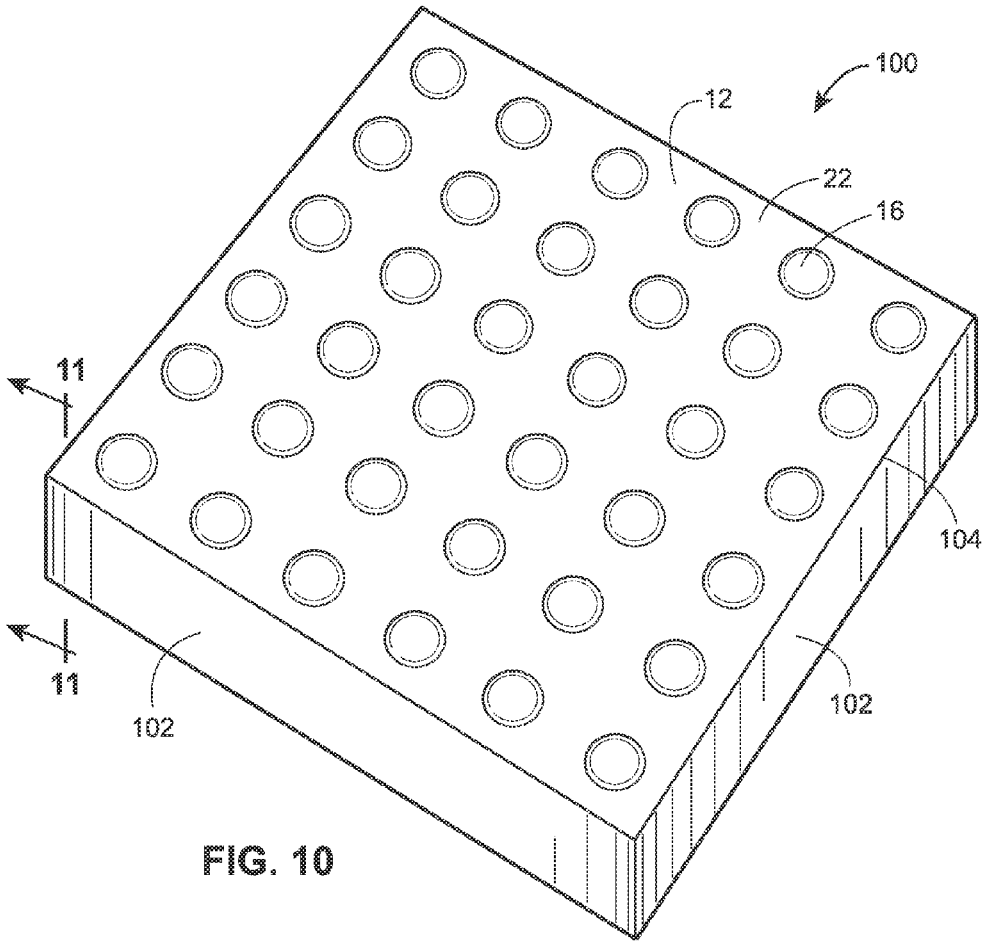
FIG. 10 is a perspective top view of an embodiment of the tactile sidewalk tile of the present disclosure.
Figure 11:
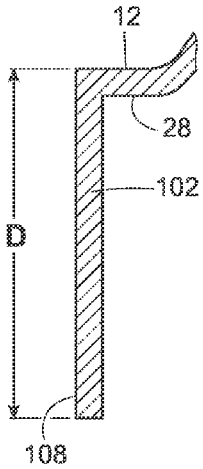
FIG. 11 is a partial sectional view of the tactile sidewalk tile of FIG. 10 taken along sectional line 11-11 in FIG. 10.
Figure 12:
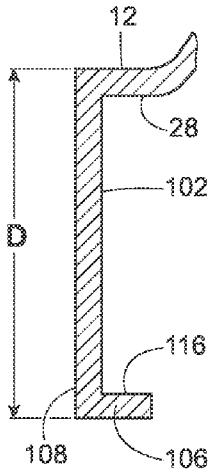
FIG. 12 is a partial sectional view of the tactile sidewalk tile of FIG. 10 taken along sectional line 11-11 in FIG. 10, wherein the sidewall has an inwardly-extending lip.

In a second embodiment that is illustrated in FIGS. 10 and 11, the tactile sidewalk tile 100 may be substantially identical to the tactile sidewalk tile 10 that has been previously described. However, instead of having an edge portion 14, the top tile surface 12 of the tactile sidewalk tile 100 is bounded by a vertical or substantially vertical sidewall 102 that extends around the entire perimeter 104 of the top tile surface 12. As illustrated in FIG. 11, the sidewall 102 extends a distance D from the top tile surface 12, and the distance D may be 1.25" or 1.50". However, the distance D may be any value suitable for a specific application. The distance D may be uniform along the entire perimeter 104 of the top tile surface 12 or, alternatively, the distance D may vary along the perimeter 104. An optional inwardly-projecting lip 106 may horizontally extend along all (or portions) of the distal edge 108 of the sidewall 102, as illustrated in FIG. 12.

Figure 13:
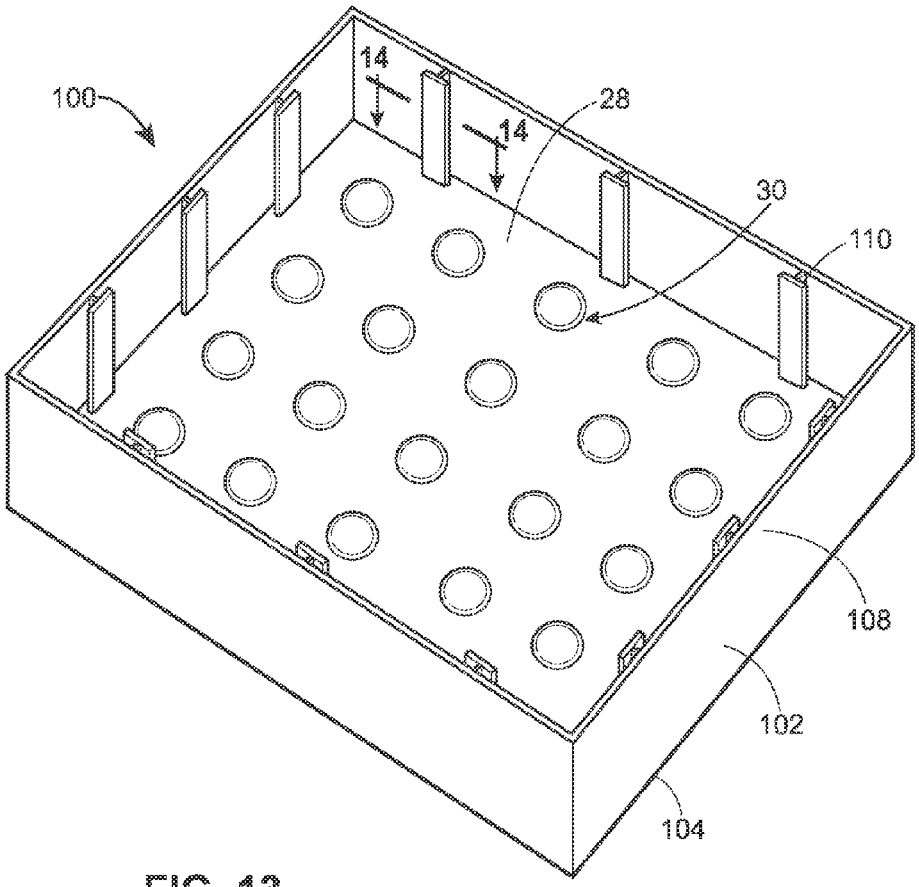
FIG. 13 is a perspective bottom view of the embodiment of the tactile sidewalk tile illustrated in FIG. 10.
Figure 14:
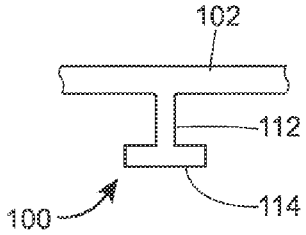
FIG. 14 is a partial sectional view of the tactile sidewalk tile of FIG. 10 taken along sectional line 14-14 in FIG. 13.

The tactile sidewalk tile 100 may include one or more retention ribs 110, as illustrated in FIGS. 13 and 14. Each retention rib 110 may include a web portion 112 extending away from an interior surface of the sidewall 102. The web portion 112 may be substantially planar and may be perpendicular to the sidewall 102. The web portion 112 may vertically extend from the bottom tile surface 28 to a point at or slightly below the distal edge 108 of the sidewall 102. Each retention rib 110 may also include a front portion 114, and the front portion 114 may be planar and may be disposed parallel to and offset from the sidewall 102. The front portion 114 may vertically extend from the bottom tile surface 28 to a point at or slightly below the distal edge 108 of the sidewall 102. The web portion 112 may intersect the front portion 114 at or near a mid-point of the front portion 114 such that the retention rib 110 has a T-shaped cross-section. The thickness of one or both of the front portion 114 and the web portion 112 may gradually decrease along the length of the retention rib 110 from the bottom tile surface 28 to the distal edge 108 of the sidewall 102.

To install the tactile sidewalk tile 100, the tactile sidewalk tile 100 is first inverted, and a filler material is poured into the volume that is defined by the interior of the sidewall 102 and the bottom tile surface 28. The filler material may be added until the filler material contacts an inner surface 116 of the lip 106 such that upon drying, the filler material is at least partially retained in the volume defined by the sidewall 102 and the bottom tile surface 28 by the lip 106. If the tactile sidewalk tile 100 does not have a lip 108, the filler material may be added until the level of the filler material is substantially adjacent with the distal edge 108 of the sidewall 102. Under the influence of gravity, the filler material migrates into the dome depression volume V, and the filler material may consequently extend beyond a portion of the flush post undercut surface 50, securing the tactile sidewalk tile 100 to the filler material in the manner previously described. In addition, the filler material may also migrate around each of the retention ribs 110 such that the filler material is disposed between the front portion 114 and the sidewall 102, thus further securing the tactile sidewalk tile 100 to the filler material. Alternatively, a layer of thinset material 72 may be buttered over the bottom tile surface 28 prior to adding the filler material, and the thinset material 72 may flow into the dome depression volume V and extend beyond a portion of the flush post undercut surface 50. The filler material may then be poured over the thinset material 72 in the manner described above. The filler material may be concrete, or may be any material suitable for a particular application.

By using the process described above, a plurality of tactile sidewalk tiles 100 may be prepared at an off-site location and shipped to the job site, thereby reducing on-site preparation time. Each of the tactile sidewalk tiles 100 can then be installed in a desired location in a manner similar to that of a paving stone (or "paver"). More specifically, a layer of packed sand (or a layer of a sand and concrete mixture) may comprise an underlying support surface for the tactile sidewalk tiles 100. The tactile sidewalk tiles 100 may be placed directly over the underlying support surface without using a bonding material. The process may be repeated until all of the tactile sidewalk tiles 100 have been installed. A grout material (or additional sand or sand/concrete mixture) may then be applied in the gaps that exist between adjacent tactile sidewalk tiles 100. If one of the tactile sidewalk tiles 100 becomes worn or damaged, the tactile sidewalk tile 100 can be pried from the underlying surface and replaced using the method described above.

Figure 15:
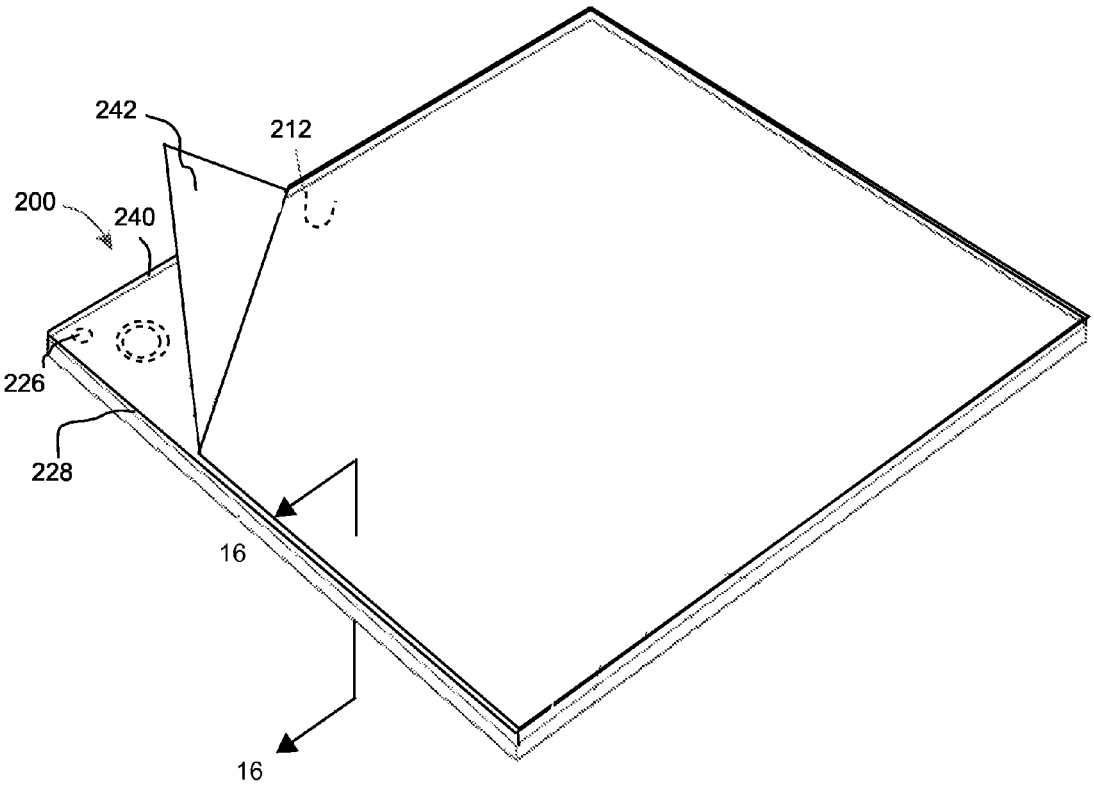
FIG. 15 is a perspective bottom view of a tactile sidewalk tile of the present disclosure, in combination with a sheet of tacky mounting material and a sacrificial release sheet.
Figure 16:
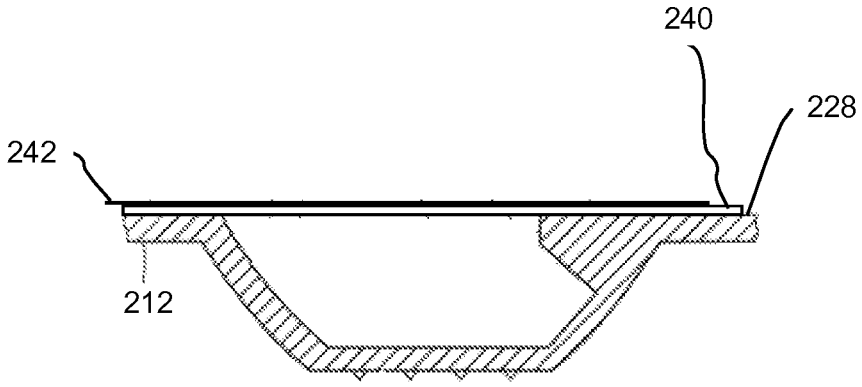
FIG. 16 is a cross-sectional view of the tactile sidewalk tile of FIG. 15, taken along lines 16-16 in FIG. 15.

Turning to FIGS. 15 and 16, a tactile sidewalk tile 200, similar to the tactile sidewalk tile 10 described above, is provided with a layer of a tacky mounting material, such as a butyl mastic sheet 240 (available from Concrete Sealants, Inc. of Tipp City, Ohio), having a thickness of about 0.050 inch. The butyl mastic sheet 240 is provided on the horizontal bottom surface 228 of the tactile sidewalk tile 200. A sacrificial release sheet 242 is disposed on an underside of the butyl mastic sheet 240 to prevent the butyl mastic sheet 240 from being exposed and sticking to other objects prior to installation. FIG. 15 illustrates a corner of the sacrificial release sheet 24 pulled up away from the butyl mastic sheet 240. The sacrificial release sheet 242 is preferably made of a waxy paper to facilitate its removal from the butyl mastic sheet 240 when desired. The tactile sidewalk tile 200 includes a plurality of fastener-receiving bores 226 therethrough, the bores extending from the horizontal top surface of the tactile sidewalk tile 200 to the horizontal bottom surface 228.

Installing the tactile sidewalk tile 200 onto a dry concrete underlying support surface includes removing the sacrificial release sheet from the sheet of tacky mounting material; positioning the tactile sidewalk tile in an orientation in which the horizontal top tile surface 212 is facing upward (i.e., flipping the tile upside down from the orientation illustrated in FIGS. 15 and 16) and placing the tactile sidewalk tile on the underlying support surface; applying pressure to the horizontal top tile surface; drilling a plurality of anchor holes through the butyl mastic sheet 240 and into the underlying support surface using the plurality of fastener-receiving bores 226 as guides; and securing a fastener through each of the plurality of fastener-receiving bores in the respective anchor holes. To anchor the fasteners into concrete, an anchor member, such as an elongate plastic anchor having an outside diameter approximately equal to, or just less than, the diameter of the fastener-receiving bores, is inserted into each of the drilled anchor holes prior to inserting the fasteners through the fastener-receiving bores.

While various embodiments have been described above, this disclosure is not intended to be limited thereto. Variations can be made to the disclosed embodiments that are still within the scope of the appended claims.

What is claimed:

1. A tactile sidewalk tile comprising:

a horizontal top tile surface and a horizontal bottom tile surface;

a plurality of truncated domes projecting vertically from the top tile surface, wherein each of the truncated domes has a corresponding dome depression formed on the bottom tile surface, each dome depression and a plane passing through the bottom tile surface at least partially defining a dome depression volume, wherein each dome depression is defined by an inner dome wall integrally formed with a dome bottom surface such that the inner dome wall and the dome bottom surface comprise a single, unitary part, the inner dome wall extending away from the bottom tile surface; and a flush post disposed in at least one of the plurality of dome depressions, the flush post having a flush post undercut surface that is at least partially disposed within the dome depression volume.

2. The tactile sidewalk tile of claim 1, further comprising:

a sheet of tacky mounting material provided on the bottom tile surface; and a sacrificial release sheet provided on an underside of the sheet of tacky mounting material.

3. The tactile sidewalk tile of claim 2, wherein the tacky mounting material is butyl mastic.

4. The tactile sidewalk tile of claim 2, wherein the sacrificial release sheet is a waxy paper.

5. The tactile sidewalk tile of claim 1, wherein the flush post comprises a flush post body and a flush post protrusion, the flush post body extending vertically from the dome bottom surface and the flush post protrusion extending horizontally from the flush post body, wherein the flush post undercut surface partially defines the flush post protrusion.

6. The tactile sidewalk tile of claim 1, wherein the flush post undercut surface extends obliquely to the flush post body.

7. The tactile sidewalk tile of claim 1, wherein the flush post protrusion includes a flush post top surface that is substantially coplanar with the bottom tile surface.

8. The tactile sidewalk tile of claim 7, wherein the flush post protrusion comprises a front protrusion wall that is substantially vertical and normal to the flush post top surface, and wherein the flush post undercut surface extends to the front protrusion wall.

9. The tactile sidewalk tile of claim 1, wherein a partially cylindrical outer surface at least partially defines the flush post body and the flush post protrusion.

10. The tactile sidewalk tile of claim 1, wherein the flush post undercut surface is disposed entirely within the dome depression volume.

11. The tactile sidewalk tile of claim 1, wherein the tactile sidewalk tile is formed from an injection molded plastic.

12. The tactile sidewalk tile of claim 11, wherein the injection molded plastic is at least one of the group of PCPBT, copolymer polyester, and PCABS.

13. The tactile sidewalk tile of claim 1, wherein the flush post comprises a flush post protrusion extending in a generally horizontal direction from an inner dome wall of the dome depression, the flush post protrusion including the flush post undercut surface, wherein the flush post undercut surface extends obliquely from an inner dome wall of the dome depression.

14. The tactile sidewalk tile of claim 1, wherein the top tile surface is bounded by an edge portion, the edge portion comprising a mitered edge.

15. The tactile sidewalk tile of claim 1, wherein a portion of the flush post body is cylindrical.

16. The tactile sidewalk tile of claim 1, wherein at least one rib extends between the flush post body and an interior surface of the dome depression.

17. The tactile sidewalk tile of claim 9, wherein a top surface of the at least one rib is substantially coplanar with the bottom tile surface.

18. A tactile sidewalk tile comprising:

a tile having a horizontal top tile surface and a horizontal bottom tile surface;

a plurality of truncated domes projecting vertically from the top tile surface, each of the truncated domes having a corresponding dome depression formed on the bottom tile surface, wherein each dome depression is defined by an inner dome wall integrally formed with a dome bottom surface such that the inner dome wall and the dome bottom surface comprise a single, unitary part, the inner dome wall extending away from the bottom tile surface;

a flush post disposed in at least one of the plurality of dome depressions, the flush post having an elongated flush post body; and a flush post protrusion extending horizontally from the flush post body, the flush post protrusion including a substantially horizontal flush post top surface, the flush post top surface being substantially coplanar with the bottom tile surface.

19. The tactile sidewalk tile of claim 18, wherein the flush post protrusion includes a front protrusion wall that is substantially vertical and normal to the flush post top surface, and wherein a flush post undercut surface extends from the front protrusion wall to a portion of the flush post body.

20. The tactile sidewalk tile of claim 19, wherein the flush post undercut surface extends obliquely from the front protrusion wall to a portion of the flush post body, and wherein the flush post undercut surface is disposed within the one of the plurality of dome depressions.

21. The tactile sidewalk tile of claim 19, wherein a partially cylindrical outer surface at least partially defines the flush post body and the flush post protrusion.

22. The tactile sidewalk tile of claim 18, wherein the top tile surface is bounded by an edge portion, the edge portion comprising a mitered edge.

* * * * *